US010704351B2

(12) United States Patent
Haugland

(10) Patent No.: US 10,704,351 B2
(45) Date of Patent: Jul. 7, 2020

(54) COLLECTING DEVICE FOR PARTICULATE MATERIAL IN A WELL AND A METHOD FOR COLLECTING THE PARTICULATE MATERIAL AND TRANSPORTING IT OUT OF THE WELL

(71) Applicant: Qinterra Technologies AS, Stavanger (NO)

(72) Inventor: Lasse Haugland, Bryne (NO)

(73) Assignee: QINTERRA TECHNOLOGIES AS, Stavanger (NO)

( * ) Notice: Subject to any disclaimer, the term of this patent is extended or adjusted under 35 U.S.C. 154(b) by 81 days.

(21) Appl. No.: 15/117,978

(22) PCT Filed: Mar. 18, 2015

(86) PCT No.: PCT/NO2015/050051

§ 371 (c)(1),
(2) Date: Aug. 10, 2016

(87) PCT Pub. No.: WO2015/142184

PCT Pub. Date: Sep. 24, 2015

(65) Prior Publication Data

US 2017/0009545 A1 Jan. 12, 2017

(30) Foreign Application Priority Data

Mar. 18, 2014 (NO) ..... 20140357

(51) Int. Cl.

| | |
|---|---|
| ***E21B 27/04*** | (2006.01) |
| ***E21B 27/00*** | (2006.01) |
| ***E21B 37/00*** | (2006.01) |

(52) U.S. Cl.
CPC ..... *E21B 27/04* (2013.01); *E21B 27/00* (2013.01); *E21B 37/00* (2013.01)

(58) Field of Classification Search
CPC ..... E21B 27/00; E21B 27/04; E21B 37/00
See application file for complete search history.

(56) References Cited

U.S. PATENT DOCUMENTS 5,447,200 A 9/1995 Dedora et al.
5,611,400 A * 3/1997 James ..... E21B 27/02 166/292

(Continued)

FOREIGN PATENT DOCUMENTS

CA 2879979 A1 2/2014
GB 2338499 A 12/1999

(Continued)

*Primary Examiner* — Robert E Fuller
*Assistant Examiner* — Lamia Quaim
(74) *Attorney, Agent, or Firm* — Gable Gotwals

(57) ABSTRACT

This invention relates to a collecting device (1) for loosening and collecting particulate material from a well. The device includes a first end portion and a second end portion; a feed pipe (6) in the first end portion; a collecting container (8) including at least one container section (10), between the feed pipe (6) and the second end portion. A conveyor (18), in the feed pipe (6), moves the particulate material in toward the collecting device (1). The device further includes a tool (20) at the leading end portion of the conveyor (18) and a fluid outlet (38) at the second end portion; a mono pump (12) driven by a motor (22); and at least one container section (10) in a flow path (40) on the pressure side of the mono pump (12). A method for loosening and collecting particulate materials from a well by means of the collecting device (1) is described as well.

23 Claims, 5 Drawing Sheets

(56) References Cited

U.S. PATENT DOCUMENTS

| | | | | |
|---|---|---|---|---|
| 7,048,056 | B1 * | 5/2006 | Blake | E21B 37/00 166/312 |
| 7,174,957 | B1 * | 2/2007 | Jokhio | E21B 27/005 166/107 |
| 8,727,009 | B2 * | 5/2014 | Davis | E21B 21/08 166/105.2 |
| 2007/0148007 | A1 * | 6/2007 | Garlow | F04B 49/20 417/44.11 |
| 2009/0173501 | A1 | 7/2009 | Kotsonis et al. | |
| 2010/0258296 | A1 * | 10/2010 | Lynde | E21B 37/00 166/105.1 |
| 2010/0258297 | A1 | 10/2010 | Lynde | |
| 2013/0284428 | A1 * | 10/2013 | Xu | E21B 27/005 166/244.1 |
| 2015/0240583 | A1 * | 8/2015 | Mineo | E21B 34/063 166/311 |

FOREIGN PATENT DOCUMENTS

| | | | | |
|---|---|---|---|---|
| NO | 315212 | B1 | 7/2003 | |
| WO | 2003036020 | A1 | 5/2003 | |
| WO | WO-03036020 | A1 * | 5/2003 | E21B 27/00 |
| WO | 2010120454 | A1 | 10/2010 | |
| WO | 2013079935 | A2 | 6/2013 | |

* cited by examiner

COLLECTING DEVICE FOR PARTICULATE MATERIAL IN A WELL AND A METHOD FOR COLLECTING THE PARTICULATE MATERIAL AND TRANSPORTING IT OUT OF THE WELL

CROSS-REFERENCE TO RELATED APPLICATIONS

This United States application is the National Phase of PCT Application No. PCT/N02015/050051 filed 18 Mar. 2015, which claims priority to Norwegian Patent Application No. 20140357 filed 18 Mar. 2014, each of which is incorporated herein by reference.

BACKGROUND OF THE INVENTION

This invention relates to a collecting device for loosening and collecting particulate materials in a well, especially in a petroleum well. It relates, more particularly, to a collecting device which includes a feed pipe with a rotatable conveyor on the suction side of a pump, the conveyor being arranged to move particulate materials up to the pump. The particulate material is carried through the pump when the pump is active and is collected in a portion of a collecting container on the pressure side of the pump. The pump works as a valve when the pump is passive, so that collected particulate material does not flow out of the collecting container when the collecting device is transported up to the surface and out of the well where the collecting container is emptied. The invention also includes a method for collecting particulate material in a well and for bringing the particulate material out of the well.

It happens relatively often that particulate materials in the form of silt, sand, loosened deposits, drill-fluid particles, cuttings and other material settle on the inside of a pipe belonging to a well in the ground. The well may be a well producing oil or a well producing a gas. Such particulate materials may, if they build up to a sufficient degree, be highly obstructive to a fluid flow through the pipe. The deposited material is normally removed by means of a collecting tool. It is known to use various types of collecting tools in connection with coiled-tubing operations, snubbing or drilling operations.

Even in smaller amounts, particulate materials may be a problem even if they do not affect the well production to any significant degree. The particulate materials may, for example, be a hindrance to maintenance works, especially when it is a question of simple methods such as cable works. It is not unusual for deposited sand and other material in a well, even in moderate amounts, to prevent tools from reaching the desired position in the well during maintenance works.

It is common to divide oil wells and gas wells into the following groups:

Conventional wells in which the largest angular deviation from the vertical direction is approximately 65 degrees.

Extended-reach wells (Extended Reach Drilled, ERD) in which the angular deviation relative to the vertical direction is larger than 65 degrees.

Horizontal wells in which some well sections have an angular deviation of approximately 90 degrees relative to the vertical direction.

According to the prior art, in conventional wells, a sand collector is used, which is lowered into the well by means of a cable, for example. The sand collector includes at least one collecting chamber. Sand collectors exist that operate in different ways. A sand collector of a first type may be hammered into the particulate material, and a sand collector of another type may suck into the particulate material by means of an integrated piston arrangement or by a plate opening to a room at atmospheric pressure, whereby the well pressure displaces the particulate material into the collecting chamber.

Most prior-art methods are simple and relatively inexpensive to implement. They are thus well suited for conventional wells in which the particulate material forms bridges covering the entire pipe cross section, and in which it is therefore easy to fill the collecting chambers with particulate materials by means of one of the above-mentioned methods.

Especially two conditions distinguish ERD wells and horizontal wells from conventional wells when it comes to particulate materials and methods of bringing the particulate materials out. Firstly, bridges of particulate material rarely form in the pipe as, owing to gravity, the particulate materials are deposited in the downward-facing circumferential half of the pipe. Prior-art collectors that are arranged to be sucked down into the particulate material are not effective when the particulate materials are distributed along the pipe, as the collectors will, in the main, be filled with fluid.

Secondly, the part of the gravity that acts on the tool in the axial direction of the well pipe decreases with the angular deviation of the well relative to the vertical axis. In horizontal well sections, the gravity on the tool in the axial direction of the well is null. Wireline tools that are dependent on the axial weight component of the tool weight in order to work satisfactorily cannot be used under such conditions. The tools may be supplemented with wireline tractors to improve progress.

The Norwegian patent 315212 discloses a collecting device which is provided with a conveyor worm in which the leading portion of the conveyor worm is provided with a scraper or another suitable tool. The conveyor worm, which is driven by a motor, is arranged to move loosened particulate materials into a collecting container. The device according to NO 315212 has also proved effective in ERD wells and horizontal wells, but has a relatively small collecting capacity.

The patent publication WO 2010/120454 discloses a collecting device for use together with a slickline. The collecting device includes a pump in the upper portion of the device. The pump sucks up particulate materials from the well through an opening in the free, lower end portion of the device. The collecting chamber of the device is positioned on the suction side of the pump. A filter which is positioned between the collecting chamber and the pump retains the particulate material in the collecting chamber while fluid passes the filter and the pump. The pump may be a mono pump. A mono pump is also termed a Moineau pump after the inventor, or a PCP (Progressive Cavity Pump). The operation of the mono pump is known to a person skilled in the art and is not described any further.

Collecting devices for removing particulate materials in a well include elongated, tubular collecting containers. Together with other necessary equipment such as a tool for loosening the particulate material, a motor for driving the tool and a device for displacing the collecting device, such as a wireline tractor, the collecting device and equipment typically form an equipment string of 15 metres. This equipment string is sluiced into the well in a known manner through a lubricator above the wellhead. The lubricator may have a capacity for sluicing in known well tools which are typically up to 30 metres long. The known collecting devices thus do not utilize the sluicing capacity. This is because known collecting devices have a limited ability to fill elongated collecting containers. It is therefore of no importance if the collecting device is provided with a longer collecting container, as this cannot be utilized. Typical known collecting devices have a capacity for removing 20-30 litres of particulate material on every trip into the well. There is a need for a collecting device which has a larger capacity, for example being able to remove 100 litres in each trip. A collecting device like that will, to a substantial degree, increase the efficiency of the work to remove particulate materials from a well. An alternative to using collecting devices as described is to provide a coiled tubing with a suitable collecting tool. It is considerably more complex to mobilize equipment for a coiled-tubing operation than for an operation using wireline-operated equipment. It will therefore be a considerable saving if wireline-operated equipment can be used as an alternative to coiled tubing to remove particulate material in the well.

Collecting devices as disclosed must be arranged in such a way that the material collected will not flow out of the collecting container when the collecting device is being brought up to the lubricator of the well. Especially in the vertical portion of the well, collected material may flow out of the collecting container. Such flow-out can be prevented by the collecting device being provided with a check valve in its lower portion. The check valve may be a flap valve.

The invention has for its object to remedy or reduce at least one of the drawbacks of the prior art or at least provide a useful alternative to the prior art.

The object is achieved, according to the invention, through the features which are specified in the description below and in the claims that follow.

The invention is defined by the independent claims. The dependent claims define advantageous embodiments of the invention.

According to a first aspect, the invention relates to a collecting device for loosening and collecting particulate material from a well, the collecting device including:

a first end portion and a second end portion;

a feed pipe in the first end portion;

a collecting container including at least one container section, between the feed pipe and the second end portion;

a conveyor in the feed pipe, the conveyor being arranged to move the particulate material in towards the collecting container;

a tool at the leading end portion of the conveyor; and a fluid outlet at the second end portion, and being such that the collecting device includes a mono pump driven by a motor and at least one container section in a flow path on the pressure side of the mono pump.

A mono pump has some properties that are advantageous when such a collecting device is used. A mono pump has a relatively low sensitivity to particulate material such as gravel and the like. The mono pump may be designed to give a satisfactory flow rate, even at a relatively low rotational speed.

The collecting device is well suited for being moved into and out of a well, in particular a petroleum well, by means of a wireline tractor. The motor of the collecting device may, with advantage, be supplied with energy from the wireline tractor, typically in the form of electrical power or a hydraulic fluid flow.

The particulate materials that are moved into the collecting container by means of the conveyor are mixed with fluid. The fluid outlet, which is typically covered by a filter, makes it possible for the fluid to follow the flow path through the collecting device. By the use of a mono pump in this flow path, the intensity of the fluid flow is increased, and thereby the amount of particulate materials entering the collecting container. A greater ratio of fullness of the collecting container is thereby achieved, before the collecting device must be emptied, than by known collecting devices.

Particulate materials present in the petroleum well are either loose or loosened by means of the tool that may be attached to the leading end portion of the conveyor. The tool may include, for example, hard-metal pieces or other suitable materials. In some cases the tool may include brushes.

The collecting device may further include at least one container section in the flow path on the suction side of the mono pump. By the use of a modular structure, the collecting device may be adapted for the prevailing conditions, both with respect to the number of container sections, which determines the size of the collecting container, and the relative position of the mono pump in the collecting device.

Much of the particulate materials may precipitate from the fluid flow in the container section on the suction side of the mono pump before the fluid passes the mono pump. In some cases, it may be advantageous for the distance of the mono pump from the conveyor to be smaller than the distance from the fluid outlet. At least a portion of the particulate materials in the fluid flow will then pass through the mono pump. This may have the advantage of the particulate materials then following the pressurized fluid further into the collecting container.

A motor housing with the motor may be positioned in the second end portion and the motor drives the mono pump via a driveshaft. Alternatively, the motor may be positioned in a lower portion of a container section on the pressure side of the mono pump and the motor drives the mono pump via a driveshaft.

The conveyor may be rotatable and connected to the mono pump by an intermediate shaft. The conveyor may typically consist of a conveyor worm with screw blades. The mono pump may be connected to the conveyor in such a way that the mono pump and the conveyor are connected to a common shaft. The shaft, which may be articulated or flexible in some other way, is arranged to accommodate the eccentric rotation characteristic of the rotor motion of a mono pump.

In its wall, the feed pipe may include at least one through-going main opening. The feed pipe may be provided with a plurality of through-going main openings distributed around the circumference of the feed pipe. The at least one through-going main opening may be elongated in the longitudinal direction of the collecting device. In its wall, the feed pipe may include at least one through-going relief opening. The feed pipe may be provided with a plurality of through-going relief openings distributed around the circumference of the feed pipe. In a wall, the collecting device may include at least one through-going auxiliary opening at the mono pump, on the suction side of the mono pump. The collecting device may be provided with a plurality of through-going auxiliary openings distributed around the circumference of the collecting device. At least one of the main opening, the relief opening and the auxiliary opening may be closable.

In a portion, the driveshaft may be provided with a screw blade. The upper portion of the driveshaft may be smooth.

At a standstill, the mono pump may form a check valve between the at least one container section on the pressure side of the mono pump and the feed pipe. This has the advantage of the mono pump possibly making a separate closing device between the tool and the collecting container redundant. Such a closing device is necessary in many cases in order to prevent a leakage of collected material from the collecting container out through the feed pipe when the collecting device is moved upwards in the vertical part of the petroleum well.

The conveyor may be supported in an outer bearing housing in the feed pipe. The outer bearing housing may be provided with through-going openings. The outer bearing housing may be provided with a closing device on the side facing the conveyor. The closing device may be a flap valve. The conveyor may be supported in an inner bearing housing in the feed pipe. The inner bearing housing may be provided with through-going openings.

According to a second aspect, the invention relates to a method for loosening and collecting particulate materials from a well by means of a collecting device as described above. The method includes:

moving the collecting device inside a well pipe up to particulate material in the well pipe;

activating the collecting device by starting the mono pump, the conveyor and the tool;

moving the tool into the particulate material to loosen the particulate material;

mixing the particulate material with a surrounding fluid and carrying the particulate material up to the suction side of the mono pump;

carrying the diluted particulate material through the mono pump and into the collecting container on the pressure side of the mono pump;

separating particulate materials and fluid in the collecting container by letting fluid flow out through the fluid outlet;

stopping the mono pump so that separated particulate materials in the collecting container are prevented from flowing out of the collecting device through the feed pipe;

moving the collecting device back and out of the well pipe; and emptying the collecting container of the collecting device of collected particulate materials.

The method may further include mixing the particulate material in the feed pipe with surrounding fluid which is flowed into the feed pipe through at least one of the main opening or the relief opening or mixing particulate material with surrounding fluid in the collecting container by flowing surrounding fluid through the auxiliary opening. The method may further include flowing surrounding fluid into the feed pipe or the collecting container selectably through at least one of the main opening, the relief opening or the auxiliary opening.

The collecting device and the method according to the invention provide for increased efficiency in cleaning work connected to ERD petroleum wells and horizontal petroleum wells.

In what follows, examples of preferred embodiments are described, which are visualized in the accompanying drawings, in which.

Figure 1:
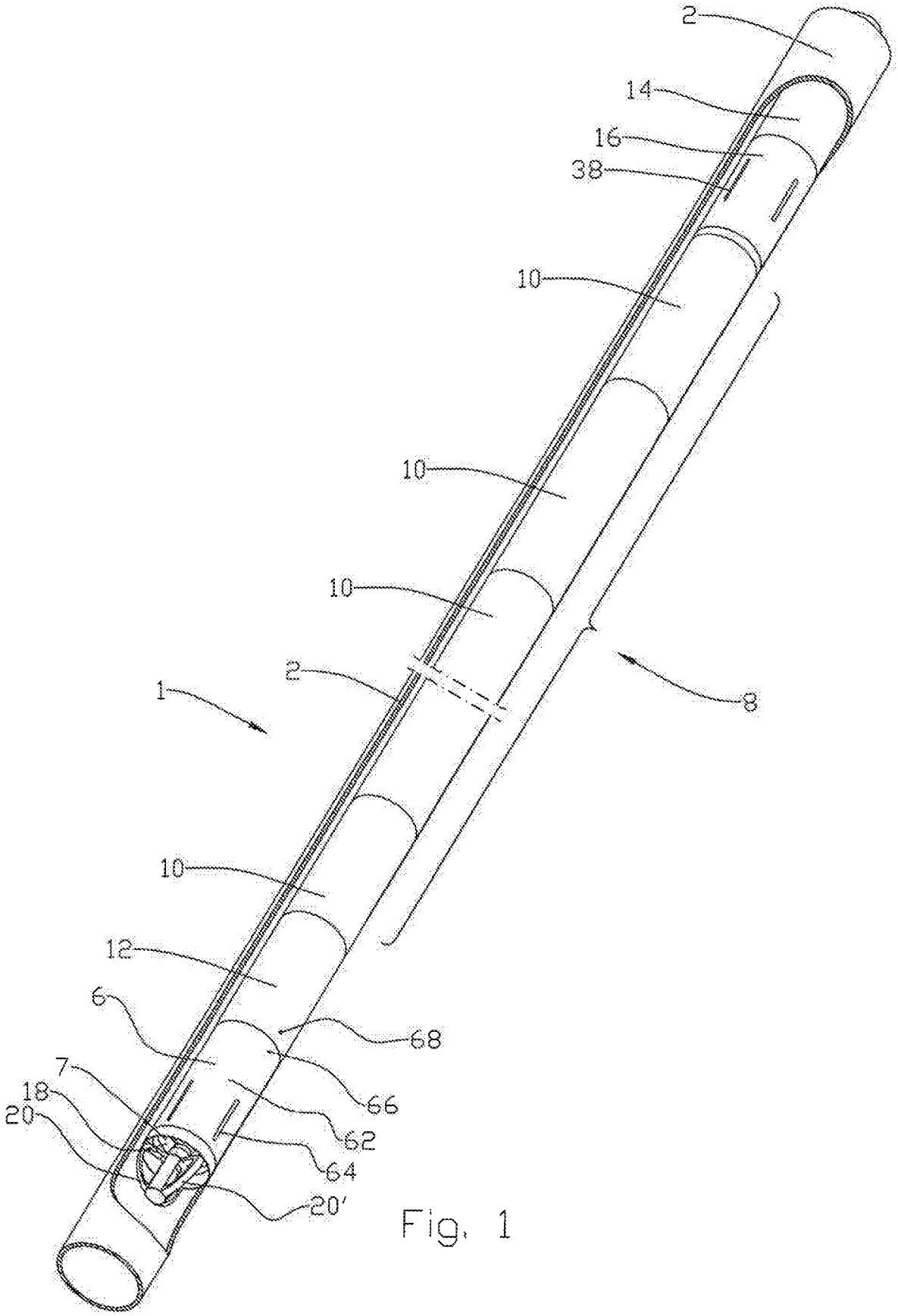
FIG. 1 shows, in perspective, a collecting device according to the invention during work in a well pipe.

In the drawings, the reference numeral 1 indicates a collecting device which is shown, in FIG. 1, in a well pipe 2. In its first end portion, the collecting device 1 includes a feed pipe 6 with an inlet 7, the feed pipe 6 being in fluid communication with a collecting container 8. The collecting container 8, which typically has a modular structure, may include one or more container sections 10. In its second end portion, the collecting device 1 further includes a top section 16, a motor housing 14 and a coupling piece (not shown) which may be attachable to a wire (not shown) or to a wireline tractor (not shown). The wireline tractor can move the collecting device 1 in the well pipe 2.

In what follows, terms like "up/at the top" and "down/at the bottom" are used to indicate directions of the collecting device 1 in its orientation in a vertical portion of a well pipe 2. Directional specifications are used according to their usual sense.

A conveyor 18 is arranged in the feed pipe 6. The conveyor 18 may be rotatable and is shown here in the form of a conveyor worm 18'. The conveyor 18 is provided with a tool 20 at its leading end portion to loosen particulate materials inside the well pipe 2. The tool 20 is shown as a scraper 20' here. The tool 20 may be of other types such as a brush, a so-called "rock bit" or a so-called PDC bit. The type of tool 20 is selected according to what type of particulate material is to be removed from the well pipe 2.

The conveyor 18 is supported in an outer bearing housing 30 which is provided with through-going openings 33 for the conveyance of particulate materials through the outer bearing housing 30. The conveyor 18 is further supported in an inner bearing housing 32, see FIG. 2. The inner bearing housing 32 is provided with through-going openings 34 for the conveyance of particulate materials through the inner bearing housing 32. The openings 34 also function as sieve openings to prevent larger particles from being carried into the collecting container 8. Further, on its side facing the conveyor 18, the outer bearing housing 30 is provided with a closing device 36 which is arranged to prevent a fluid flow in the direction from the feed pipe 6 to the tool 20. The closing device 36 may include a flap valve. In some cases in which the particulate materials have a high viscosity, the closing device 36 may be left out to facilitate the subsequent emptying of the collecting device 1. Particles passing the through-going openings 33, but being too big to pass the through-going openings 34, are retained by the closing device 36. These particles will be transported out of the well pipe 2 internally in the feed pipe 6.

A mono pump 12 is positioned between the inner bearing housing 32 and the collecting container 8. The conveyor 18 is thus positioned on the suction side of the mono pump 12, and the collecting container 8 is positioned on the pressure side of the mono pump 12, as is shown in the embodiments according to FIGS. 2-4. The through-going openings 34 prevent particles which may damage the mono pump 12 from being carried all the way up to the inlet (not shown) of the mono pump 12.

Figure 2:
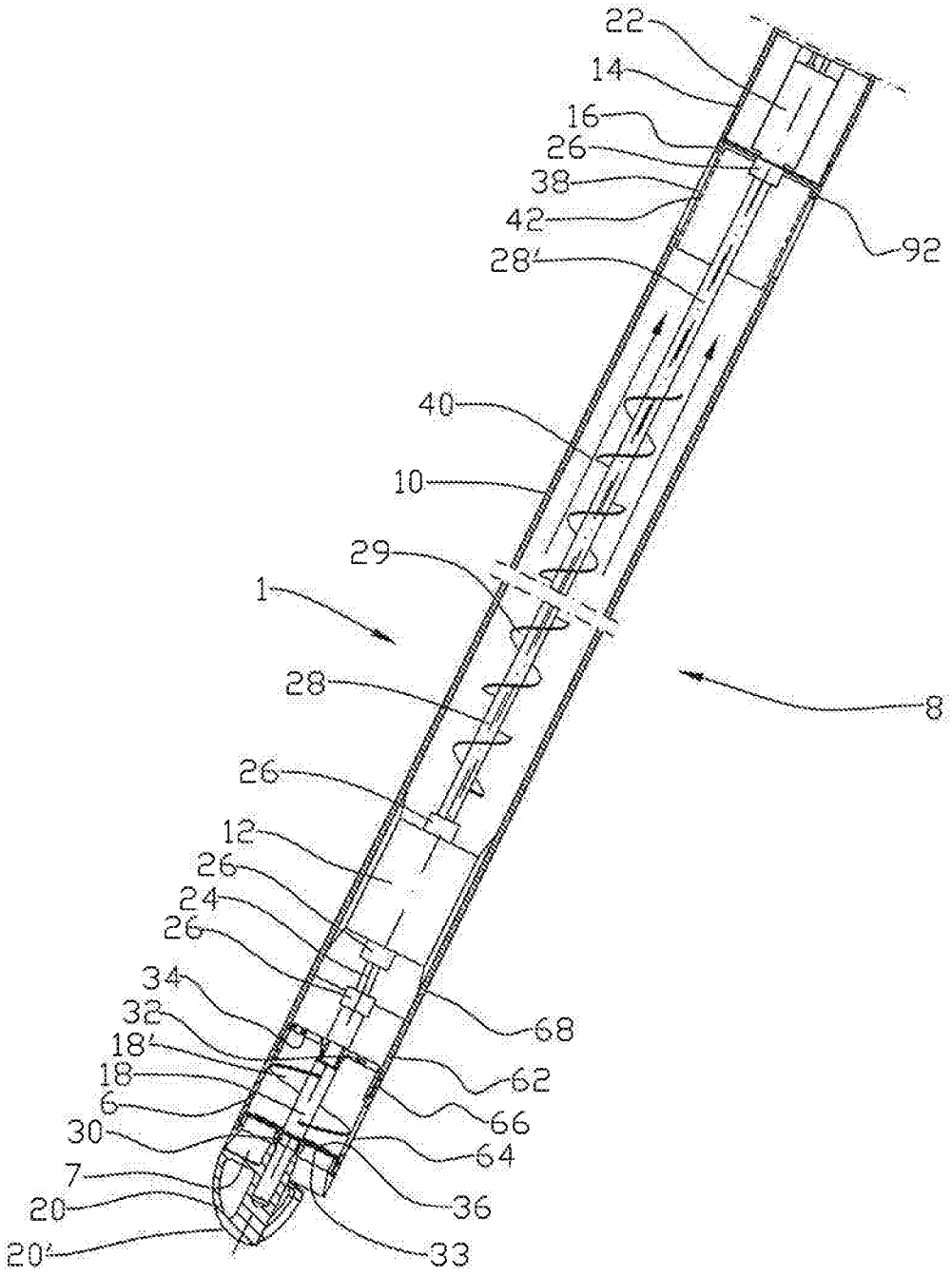
FIG. 2 shows a longitudinal section of the collecting device of FIG. 1.

The motor 22 in the motor housing 14 drives the mono pump 12 via a driveshaft 28. Owing to the operation of the mono pump 12, the driveshaft 28 is provided with articulations 26. An intermediate shaft 24, which is also articulated, extends from the mono pump 12 to the conveyor 18. The driveshaft 28 may be provided with a number of screw blades 29 as shown in FIG. 2. The motor 22 thus drives the conveyor 18 and the tool 20 via the driveshaft 28, the mono pump 12, the intermediate shaft 24 and the associated articulations 26.

The collecting container 8 may include several container sections 10. Each container section 10 may include a portion of the driveshaft 28 and the screw blade 29. Each container section 10 is provided with an upper shaft support (not shown) and a lower shaft support (not shown). In one embodiment, the container section 10 which is positioned the closest to the motor 22 may be provided with a driveshaft 28 with an upper smooth portion 28' nearest to the motor 22, see FIG. 2. This smooth portion 28' also extends through the top section 16.

In a lower portion of a wall 62, the feed pipe 6 is shown as provided with a plurality of through-going main openings 64. In its upper portion, the wall 62 is shown as provided with a plurality of through-going relief openings 66. The main openings 64 are shown as elongated openings in the longitudinal direction of the collecting device 1. The openings 64, 66 are distributed around the circumference of the feed pipe 6.

The collecting device 1 is further shown as provided with through-going auxiliary openings 68 in a wall right under the stator (not shown) of the mono pump 12. Auxiliary openings 68 are distributed around the circumference of the collecting device 1.

The openings 64, 66 and 68 may selectably and mutually independently be opened and closed with closing devices (not shown).

In its wall 92, the top section 16 between the upper container section 10 and the motor housing 14 is provided with a plurality of fluid outlets 38. In the figures, the fluid outlets 38 are shown as elongated, through-going openings in the wall 92. The fluid outlets 38 are distributed around the circumference of the top section 16. On its inside, the fluid outlet 38 may be provided with a filter 42 as is shown in FIG. 2. In an embodiment not shown, a container section 10 which is positioned the furthest from the tool 20 may be provided with a plurality of fluid outlets 38 and an internal filter 42.

The feed pipe 6, the mono pump 12, the collecting container 8, the filter 42 and the fluid outlet 38 form a flow path 40 through the collecting device 1.

Figure 3:
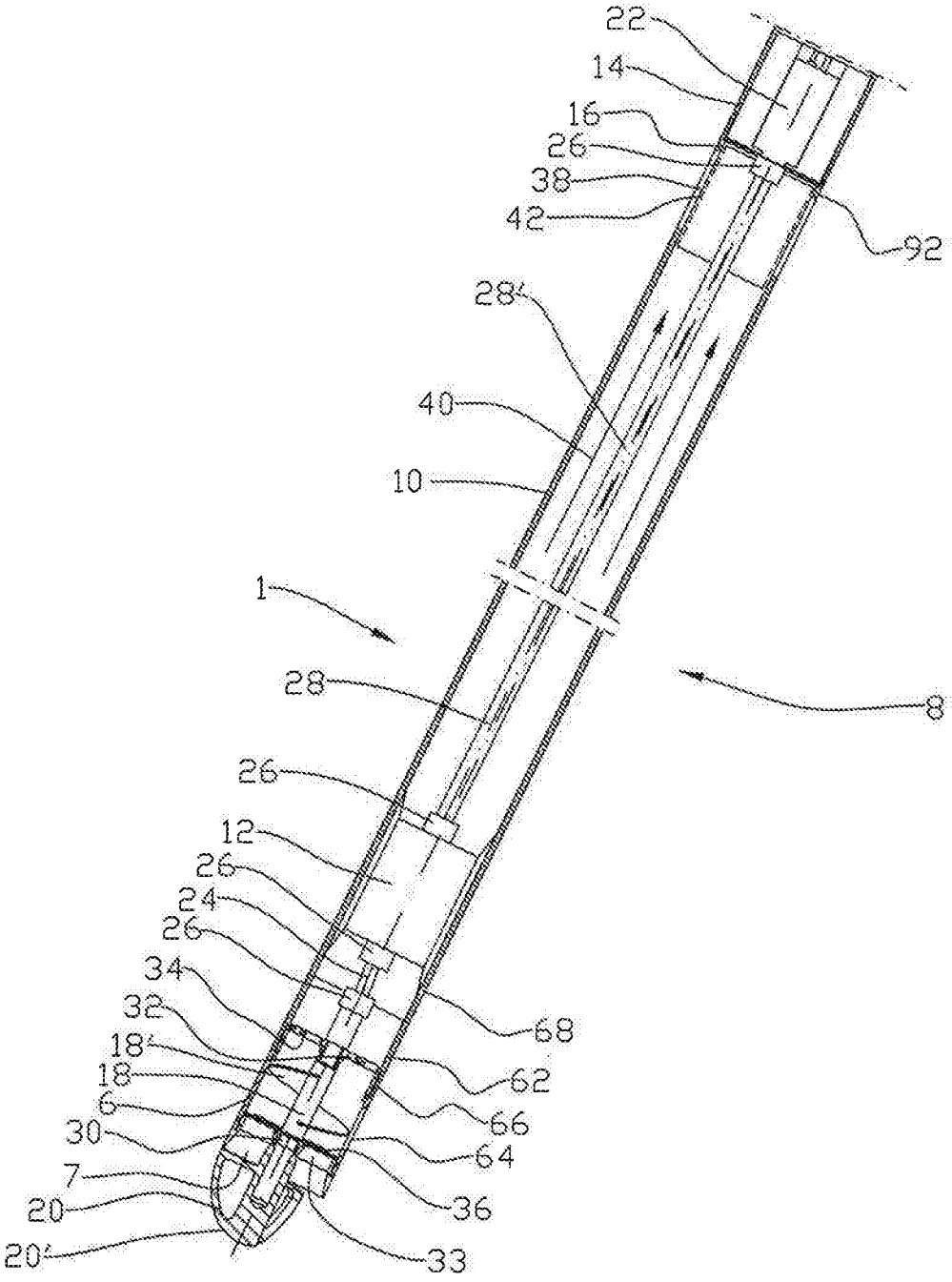
FIG. 3 shows a longitudinal section on the same scale as FIG. 2 of the collecting device in an alternative embodiment.

The collecting device 1 is shown in an alternative embodiment in FIG. 3. In this embodiment, the smooth portion 28' of the driveshaft 28 is extended through the entire collecting container 8. This may be advantageous when the mixture of particulate material and fluid is loose and the mono pump 12 yields a pressure so high that the mixture may flow up to the filter 42. Screw blades 29, if any, may brake the mixture along the flow path 40.

Figure 4:
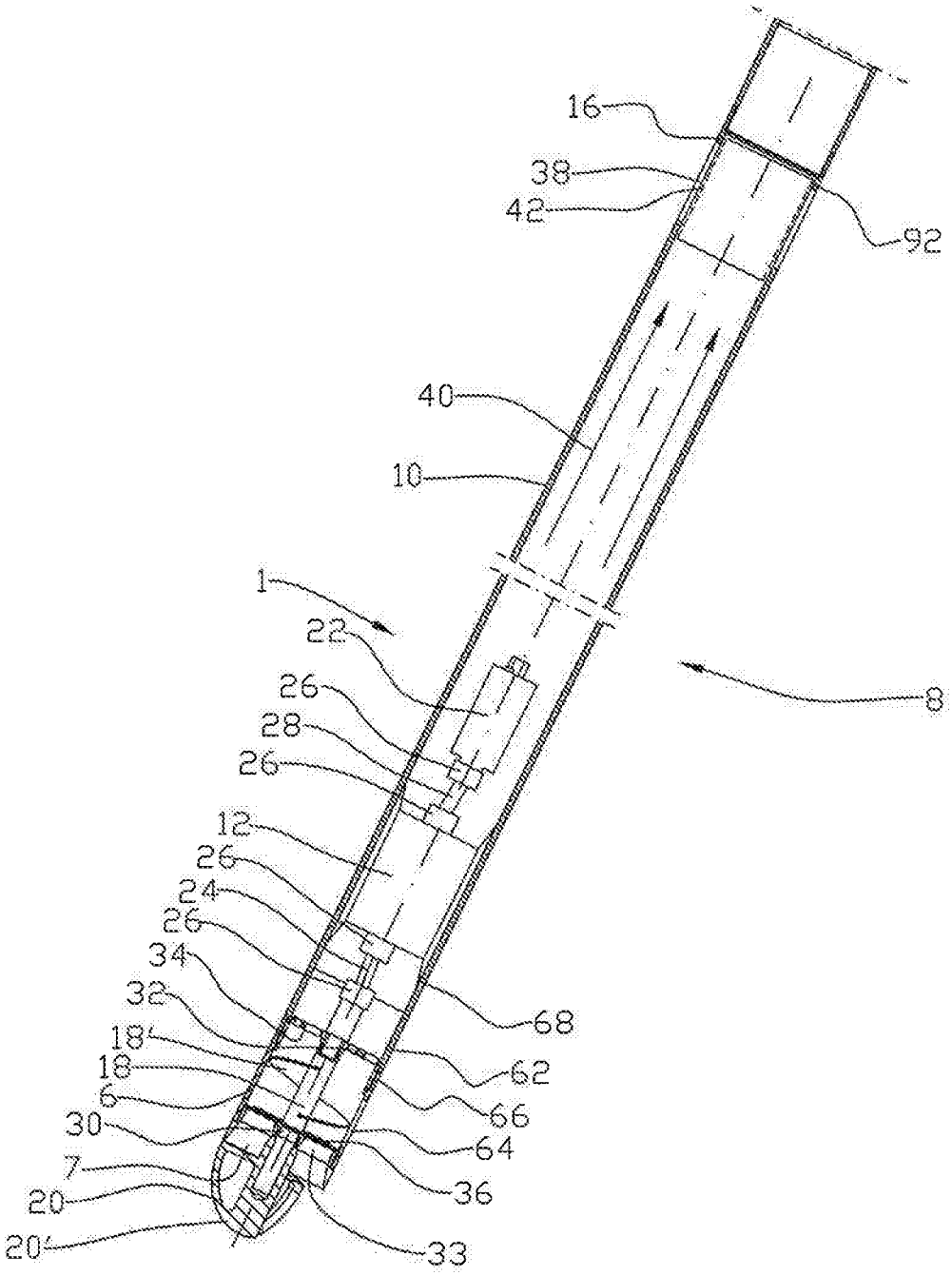
FIG. 4 shows a longitudinal section on the same scale as FIG. 2 of the collecting device in a further alternative embodiment.

The collecting device 1 is shown in a further alternative embodiment in FIG. 4. In this embodiment, the motor 22 is positioned at the bottom of the collecting container 8 in a lower portion of a container section 10. Mounting brackets for the motor 22 and wires for the energy supply to the motor 22 are not shown. This embodiment has the advantage of enabling the collecting container 8 to be without any internal obstacles from the motor 22 to the filter 42 with no supports for a driveshaft 28. This simplifies the assembly of several container sections 10 into one collecting container 8. It also leads to there being fewer restrictions and obstructions along the flow path 40.

Figure 5:
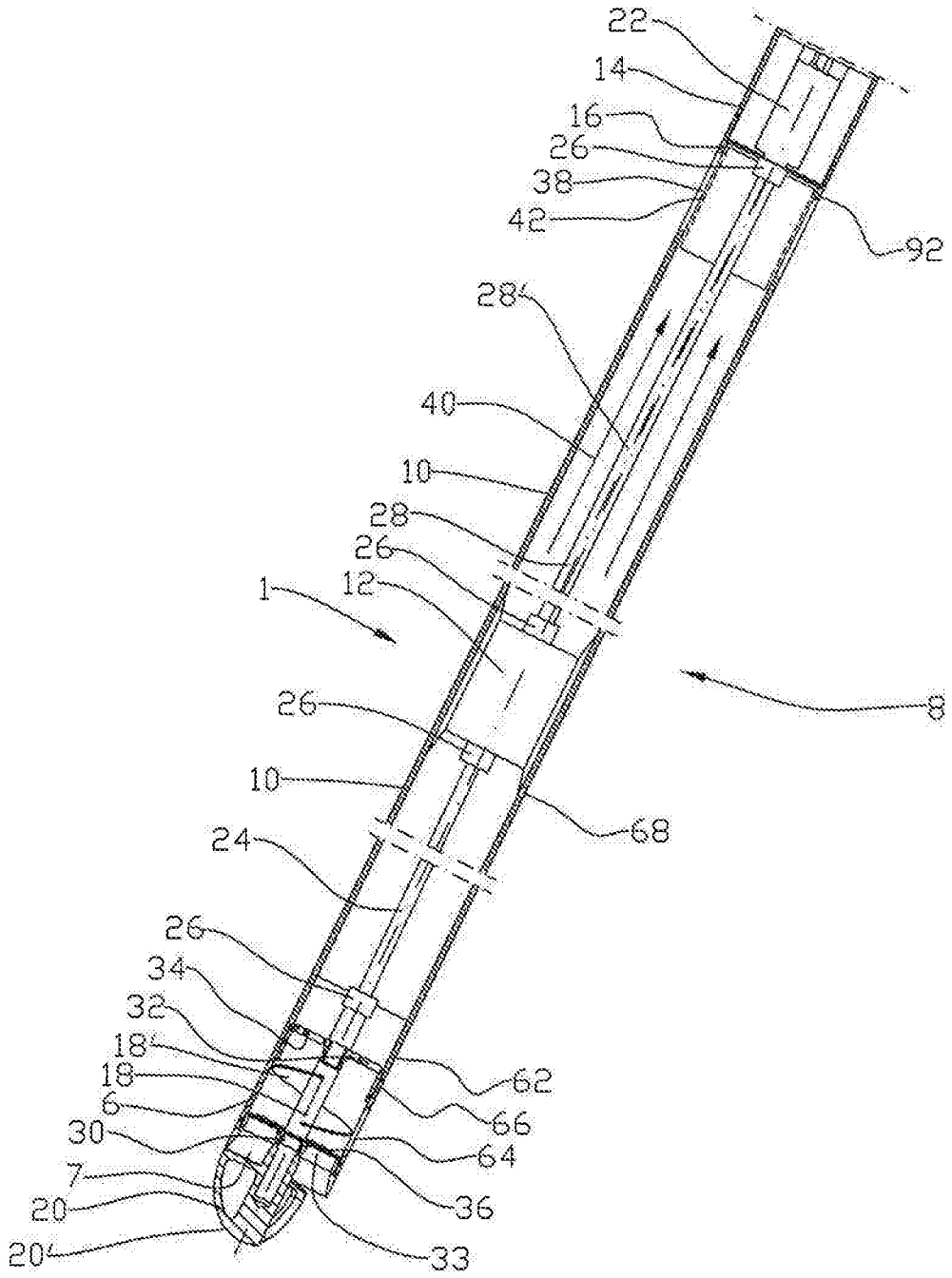
FIG. 5 shows a longitudinal section on the same scale as FIG. 2 of the collecting device in a further alternative embodiment.

The collecting device 1 is shown in a further alternative embodiment in FIG. 5. In this embodiment, the collecting device 1 is provided with at least one container section 10 on the suction side of the mono pump 12 and at least one container section 10 on the pressure side of the mono pump 12. Collected particulate materials in the collecting container 8 on the suction side of the mono pump 12 are retained by the closing device 36 so that they cannot flow out of the collecting container 8. FIG. 5 shows an embodiment in which the smooth portion 28' of the driveshaft 28 is extended through the entire part of the collecting device 8 located on the pressure side of the mono pump 12. The intermediate shaft 24 is also shown as a smooth shaft.

In an embodiment not shown, the collecting device 1 shown in FIG. 5 may be provided with a driveshaft 28 with screw blades 29 as shown in FIG. 2. The driveshaft 28 may have a smooth portion 28' extending through the top section 16. In a further embodiment (not shown), the intermediate shaft 24 may be provided with a number of screw blades (not shown). In further embodiments not shown, an intermediate shaft 24 with or without screw blades may be combined with a driveshaft 28 with or without screw blades 29.

In an embodiment not shown, the collecting device 1 shown in FIG. 5 may be provided with a motor 22 in a lower portion of a container section 10 as is shown in FIG. 4. The intermediate shaft 24 may be without screw blades as shown in FIG. 5 or with screw blades (not shown).

When the collecting device 1 is moved into the well pipe 2 by means of a wireline tractor (not shown), for example, the resistance to propulsion increases for the wireline tractor as the collecting device 1 is moved into particulate materials. It may be advantageous to pull the collecting device 1 back somewhat when the particulate material has been localized. Then the collecting device 1 is activated and the collecting device 1 is eased into the particulate material with the conveyor 18 activated, tool 20 activated and pump 12 activated. Thereby the particulate materials are loosened while, at the same time, the tool 20 feeds the particulate materials into the conveyor 18. The particulate materials are then displaced internally through the feed pipe 6 by means of the rotating conveyor 18 while the particulate material is simultaneously mixed with ambient fluid entering through at least one of the openings 64, 66, 68. The mixture is carried up to the suction side of the mono pump 12 through the openings 34 in the inner bearing housing 32. The mono pump 12 pumps the mixture of particulate materials and ambient fluid into the collecting container 8.

In well pipes 2 oriented vertically, the particulate materials may form a relatively firm bridge or plug. The tool 20 will dig particulate materials on the surface of the well loose. Fluid present on the surface of the well will mix with the particulate materials and a mixture of fluid and particulate materials is carried into the feed pipe 6. Surrounding fluid may also enter the feed pipe 6 through the main openings 64. The conveyor 18 will further mix particulate materials and fluid together and carry this mixture to the suction side of the mono pump 12. The mixture is carried through the mono pump 12 and out on the pressure side of the mono pump 12. The mixture is carried upwards in the collecting container 8 by a pressure higher than the ambient pressure. In one embodiment as shown, in which the driveshaft 28 is provided with screw blades 29 in a portion, the screw blades 29 will further contribute to the mixture of fluid and particulate materials being carried upwards in the collecting container 8. The fact that the particulate materials are on the pressure side of the mono pump 12 will alone enable the use of an extended collecting container 8. The fact that the driveshaft 28 is provided with screw blades 29 will, in combination with the fact that it is on the pressure side of the mono pump 12, further help to enable the use of an extended collecting container 8.

The openings 34 of the inner bearing housing 32 are chosen with a size that will prevent particles that may damage the mono pump 12 from being carried up to the mono pump 12.

If the particulate materials form a bridge which is so loose that the collecting device 1 sinks into the particulate materials until they cover the main openings 64, the loosened material could be too dry for the mono pump 12 to function effectively. The relief openings 66 are therefore opened so that surrounding fluid may enter the feed pipe 6 through the relief openings 66. If the particulate materials are so loose that even the relief openings 66 are covered, the auxiliary openings 68 are opened so that surrounding fluid may enter the collecting device 1 between the inner bearing housing 32 and the mono pump 12 through the auxiliary openings 68. The auxiliary openings 68 are chosen with a size that will prevent particles that may damage the mono pump 12 from flowing through the auxiliary openings 68. It is thereby ensured that the mono pump 12 will be fed a mixture of particulate material and surrounding fluid.

The mixture of particulate materials and fluid is carried upwards in the collecting container 8 to the top section 16 along the flow path 40. In the top section 16, fluid exits through the filter 42 and the fluid outlet 38 as the pressure inside the collecting container 8 is higher than the ambient pressure. The particulate materials that have a size which is larger than the mesh size of the filter 42 are retained by the filter 42 and separated from the fluid. The separated particles sink down in the collecting container 8 along the inner wall of the collecting container 8.

When the collecting container 8 is filled up with particulate material, the mono pump 12 is stopped. Fluid and particles cannot flow through the mono pump 12 when the rotor (not shown) is stationary relative to the stator. Therefore, at a standstill, the mono pump 12 will function as a check valve which prevents the mixture of fluid and particles from flowing out of the collecting container 8 and out through the feed pipe 6 when the collecting device 1 is being returned to the surface where the collecting container 8 is emptied.

The cleaning operation is repeated until the particulate materials have been removed.

In deviation wells, whether ERD wells or horizontal wells, the method is the same. In such wells, the particulate materials do not form bridges. In most cases, one or more of the main openings 64 will face upwards and not be buried in particulate material. This ensures that surrounding fluid will enter the feed pipe 6 and mix with loosened particulate materials there.

It should be noted that all the above-mentioned embodiments illustrate the invention, but do not limit it, and persons skilled in the art may form many alternative embodiments without departing from the scope of the attached claims. In the claims, reference numerals in brackets are not to be seen as restrictive. The use of the verb "to comprise" and its various forms does not exclude the presence of elements or steps that are not mentioned in the claims. The indefinite articles "a" or "an" before an element does not exclude the presence of several such elements.

The fact that some features are specified in mutually different, dependent claims does not indicate that a combination of these features cannot be used with advantage.

The invention claimed is:

1. A collecting device for loosening and collecting particulate material from a well, the collecting device comprising:

a first end portion and a second end portion;

a feed pipe with an inlet in the first end portion;

a collecting container including at least one container section, between the feed pipe and the second end portion, said feed pipe being in fluid communication with the collecting container;

a conveyor worm within the feed pipe, the conveyor worm being supported in an outer bearing housing and an inner bearing housing, the conveyor worm being arranged to move the particulate material in towards the collecting container;

a tool at the leading end portion of the conveyor worm;

a mono pump driven by a motor, said mono pump is positioned above the inner bearing housing and between the feed pipe and the second end portion such that the feed pipe is located on a suction side of the mono pump;

a fluid outlet provided with an internal filter at the second end portion, such that the fluid outlet and the internal filter are located at a pressure side of the mono pump, said fluid outlet being in fluid communication with the collecting container;

at least one of the at least one container section in a flow path through the collecting device on a pressure side of the mono pump; and at least one through-going inlet opening through a tubular wall at the suction side of the mono pump.

2. The collecting device according to claim 1, wherein the collecting device further includes at least one container section in the flow path on the suction side of the pump.

3. The collecting device according to claim 1, wherein a motor housing with the motor is positioned in the second end portion, and the motor drives the mono pump via a driveshaft.

4. The collecting device according to claim 1, wherein the motor is positioned in a lower portion of a container section on the pressure side of the mono pump and the motor drives the mono pump via a driveshaft.

5. The collecting device according to claim 1, wherein the conveyor worm is rotatable and connected to the mono pump by an intermediate shaft.

6. The collecting device according to claim 1, wherein the feed pipe includes at least one through-going inlet main opening in its wall.

7. The collecting device according to claim 6, wherein the feed pipe is provided with a plurality of through-going inlet main openings distributed around the circumference of the feed pipe.

8. The collecting device according to claim 6, wherein the at least one through-going inlet main opening is elongated in the longitudinal direction of the collecting device.

9. The collecting device according to claim 1, wherein the feed pipe includes at least one through-going inlet relief opening in its wall.

10. The collecting device according to claim 9, wherein the feed pipe is provided with a plurality of through-going inlet relief openings distributed around the circumference of the feed pipe.

11. The collecting device according to claim 1, wherein, in a wall, the collecting device includes at least one through-going inlet auxiliary opening at the mono pump on the suction side of the mono pump.

12. The collecting device according to claim 11, wherein the collecting device is provided with a plurality of through-going inlet auxiliary openings distributed around the circumference of the collecting device.

13. The collecting device according to claim 6, wherein at least one of the inlet openings is closable.

14. The collecting device according to claim 1, wherein, in a portion, a driveshaft is provided with a screw blade.

15. The collecting device according to claim 1, wherein an upper portion of a driveshaft is smooth.

16. The collecting device according to claim 1, wherein, at a standstill, the mono pump constitutes a check valve between the at least one container section on the pressure side of the mono pump and the feed pipe.

17. The collecting device according to claim 1, wherein the outer bearing housing is provided with through-going openings and with a closing device on a side facing the conveyor worm from the first end portion towards the second end portion.

18. The collecting device according to claim 1, wherein the inner bearing housing is provided with through-going openings.

19. A method for loosening and collecting particulate material from a well by means of a collecting device according to claim 1, wherein the method comprises the following steps:

moving the collecting device inside a well pipe up to particulate material in the well pipe;

activating the collecting device by starting the mono pump, the conveyor worm and the tool;

moving the tool into the particulate material to loosen the particulate material;

mixing the particulate material with a surrounding fluid and carrying the particulate material up to the suction side of the mono pump;

carrying a diluted particulate material through the mono pump positioned downstream to the feed pipe and into the collecting container on the pressure side of the mono pump;

separating particulate materials and fluid in the collecting container by letting fluid flow out through an internal filter and a fluid outlet at the mono pump's pressure side:

stopping the mono pump so that separated particulate materials in the collecting container are prevented from flowing out of the collecting device through the feed pipe;

moving the collecting device back and out of the well pipe; and emptying the collecting container of the collecting device of collected particulate material.

20. The method according to claim 19, wherein the method further includes mixing particulate material in the feed pipe with surrounding fluid which is flowed into the feed pipe through a member selected from the group consisting of at least one of the inlet main opening, the inlet relief opening and the inlet auxiliary opening.

21. The method according to claim 20, wherein the method further includes flowing surrounding fluid into the feed pipe selectively through at least one opening by closing at least one of the inlet main opening, the inlet relief opening and the inlet auxiliary opening.

22. The method according to claim 19, the mono pump being a progressive cavity pump.

23. The collecting device according to claim 1, the mono pump being a progressive cavity pump.

* * * * *